US012534927B2

(12) United States Patent
Leung et al.

(10) Patent No.: US 12,534,927 B2
(45) Date of Patent: Jan. 27, 2026

(54) SYSTEMS AND METHODS FOR A CONTAINER WITH PORTHOLES

(71) Applicant: POLYGROUP MACAU LIMITED (BVI), Tortola (VG)

(72) Inventors: Chi Yin Alan Leung, Shenzhen (CN); Ricky Tong, Shenzhen (CN)

(73) Assignee: Polygroup Macau Limited (BVI), Tortola (VG)

( * ) Notice: Subject to any disclaimer, the term of this patent is extended or adjusted under 35 U.S.C. 154(b) by 0 days.

(21) Appl. No.: 18/585,386

(22) Filed: Feb. 23, 2024

(65) Prior Publication Data

US 2024/0191532 A1 Jun. 13, 2024

Related U.S. Application Data

(63) Continuation of application No. 17/160,107, filed on Jan. 27, 2021, now Pat. No. 11,946,280, which is a continuation of application No. 16/533,177, filed on Aug. 6, 2019, now Pat. No. 11,500,388, which is a continuation of application No. 14/565,640, filed on Dec. 10, 2014, now Pat. No. 10,385,579.

(Continued)

(51) Int. Cl.
*E04H 4/14* (2006.01)
*E04H 4/00* (2006.01)

(52) U.S. Cl.
CPC ..... *E04H 4/14* (2013.01); *E04H 4/0025* (2013.01); *E04H 4/0056* (2013.01); *E04H 2004/0068* (2013.01); *E04H 4/144* (2013.01); *Y10T 156/1057* (2015.01)

(58) Field of Classification Search
CPC ..... E04H 2004/146; E04H 2004/0068; E04H 4/0025; E04H 4/0056; E04H 4/14; E04H 4/0012; E04H 4/1244; E04H 4/1277; E04H 2015/202; E04H 2015/203; E04H 2015/204; E04H 2015/205; E04H 15/003; E04H 15/006; E04H 15/008; E04H 15/20; E04H 4/0018; E04H 4/0031; E04H 4/0037; E04H 4/0043; A61H 2201/0103; B32B 37/065; A47K 3/38
USPC ..... 4/488, 489, 506, 513; 220/662, 663
See application file for complete search history.

(56) References Cited

U.S. PATENT DOCUMENTS 2,010,472 A 8/1935 Angel
2,172,864 A 9/1939 Calva et al.
(Continued)

FOREIGN PATENT DOCUMENTS

DE 2020/05012117 10/2005
DE 2020/09013588 2/2010
(Continued)

*Primary Examiner* — Erin Deery
(74) *Attorney, Agent, or Firm* — Finnegan, Henderson, Farabow, Garrett & Dunner, LLP

(57) ABSTRACT

Disclosed is a container, such as an above-ground pool, with an improved porthole. The container can include a base, a side wall joined to the base, and at least one porthole. The porthole can comprise an aperture in the side wall and a generally transparent window sheet attached to the side wall and completely covering the aperture in the side wall. Such a design can be stronger and more durable than conventional portholes. The pool can also have portability and storability characteristics that are superior to those of conventional pools.

19 Claims, 10 Drawing Sheets

Related U.S. Application Data

(60) Provisional application No. 61/915,221, filed on Dec. 12, 2013.

(56) References Cited

U.S. PATENT DOCUMENTS

| | | | | |
|---|---|---|---|---|
| 2,619,101 | A | 11/1952 | McGerry et al. | |
| 2,875,528 | A * | 3/1959 | Garate | A63B 69/12 359/860 |
| 3,190,663 | A | 6/1965 | Stilwell | |
| 3,555,575 | A | 1/1971 | Schwarz et al. | |
| 3,573,151 | A | 3/1971 | Dawbarn | |
| 3,899,622 | A | 8/1975 | Geiger | |
| 4,675,923 | A | 6/1987 | Ashley | |
| 4,825,605 | A | 5/1989 | Weir | |
| 5,345,622 | A | 9/1994 | Plone | |
| 5,416,932 | A * | 5/1995 | Ventrice | E04H 4/14 4/496 |
| D376,636 | S | 12/1996 | Betz | |
| 5,985,071 | A | 11/1999 | Wynne et al. | |
| 6,571,405 | B1 | 6/2003 | Saputo et al. | |
| 6,588,028 | B1 * | 7/2003 | Wu | E04H 4/0025 4/506 |
| 6,913,385 | B1 * | 7/2005 | Sagos | E04H 4/14 383/23 |
| 2004/0040082 | A1 | 3/2004 | Fireman et al. | |
| 2006/0080770 | A1 * | 4/2006 | Rich | A47K 3/38 4/558 |
| 2008/0041399 | A1 | 2/2008 | Kriek | |
| 2009/0094734 | A1 | 4/2009 | Diebel et al. | |
| 2009/0151065 | A1 | 6/2009 | Watson | |
| 2016/0047516 | A1 | 2/2016 | Taylor | |
| 2017/0067268 | A1 | 3/2017 | Tong et al. | |

FOREIGN PATENT DOCUMENTS

| | | |
|---|---|---|
| DE | 2020/10003733 | 9/2010 |
| WO | WO 2007/025074 | 3/2007 |
| WO | WO 2010/018304 | 2/2010 |

* cited by examiner

SYSTEMS AND METHODS FOR A CONTAINER WITH PORTHOLES

CROSS-REFERENCE TO RELATED APPLICATION AND PRIORITY CLAIM

This application claims the benefit, under 35 U.S.C. § 120 to U.S. application Ser. No. 17/160,107, filed on Jan. 27, 2021, (now allowed) which is a continuation of U.S. application Ser. No. 16/533,171 filed on Aug. 6, 2019, now U.S. U.S. Pat. No. 10,934,731 issued on Mar. 2, 2021, which is a continuation of U.S. patent application Ser. No. 14/565,640 entitled "SYSTEMS AND METHODS FOR A CONTAINER WITH PORTHOLES," filed 10 Dec. 2014, now U.S. Pat. No. 10,385,579, issued on Aug. 20, 2019 which claims benefit under 35 U.S.C. § 119 (e), of U.S. Provisional Patent Application No. 61/915,221, filed 12 Dec. 2013, entitled "SYSTEMS AND METHODS FOR A CONTAINER WITH PORTHOLES," the entire contents and substance of each of which is incorporated herein by reference in its entirety as if fully set forth below.

BACKGROUND

1. Field of the Invention

The present invention relates to collapsible containers and, more specifically, to swimming pools having improved portholes.

2. Description of Related Art

A variety of above-ground swimming pools are known. The most common types of above-ground pools are formed from molded plastic and permanently take on the shape of a small, portable swimming pool. These pools exist in a variety of shapes and sizes, and consumers are able to choose a specific portable pool that suits their particular needs.

One problem with the conventional above-ground pools, however, is that there is not a manner of viewing the inside of the pool from outside the pool, other than from above. It is desirable, however, for a person to be able to see inside the pool from the outside, as this provides a way for the person to watch what is happening inside of the pool without getting in the pool. A parent, for example, could watch his or her children as they swim in the pool, thereby increasing the child's safety without requiring the parent to get wet. Likewise, it is enjoyable for a person in the pool, such as a child, to be able to watch and communicate with people outside the pool. Windows and portholes can provide this functionality. However, there are generally not windows or portholes in conventional above-ground pools.

While attempts have been made to manufacture above-ground pools with portholes, these attempts have encountered several quality-related obstacles. Commonly, for example, the porthole designs lack sufficient structural integrity, and often leak or cause structural failure, thereby shortening the useful life of the pool.

Another problem associated with above-ground pools is that they are cumbersome. Because the pools often have an awkward size and shape, they are often difficult to transport, as they can be larger than many vehicles. Thus, to transport a conventional pool, a consumer must typically strap it to the roof of a vehicle, or if the pool is too large, the consumer must make arrangements for oversized vehicle transport.

Moreover, such pools are often difficult and awkward to handle or carry, even for short distances.

In addition to the problems associated with transporting conventional pools, the pools are generally so large that they are difficult to store. In fact, among certain consumers, the pools have become disposable due to the difficulties of storage. Oftentimes, for example, consumers will purchase one of these portable pools at the beginning of the summer swimming season, and simply discard it during the colder months when it would otherwise need to be stored. This practice, however, is viewed by many as wasteful, and is preferably avoided.

Another problem with conventional molded plastic pools is that they are easily breakable. Because of this problem, the difficulty in storing such items is exacerbated as they cannot easily be bent or manipulated without the risk of breaking the item. Additionally, because of the manner in which children play in and around an above-ground pool, the fact that they are easily breakable is highly undesirable since it could potentially cause or contribute to injuries.

Accordingly, it would be desirable to have an above ground pool with portholes or windows. The portholes, however, should be sufficiently strong to prevent leaks and structural failure. Moreover, it would be desirable to develop a pool that exhibits the portability of an inflatable pool, but which does not require the same time and energy expenditure. Finally, it would be desirable for such a pool to be simple to store. It is to these needs, as well as others, that embodiments of this invention are directed.

SUMMARY

A collapsible container with improved portholes is described. Specifically, in some embodiments, the invention provides a collapsible swimming pool with improved portholes. The portholes can be attached to the pool with multiple welds in a concentric pattern, making the portholes stronger than conventional portholes and less likely to fail. The swimming pool exhibits the portability and ease of storage of an inflatable or portable pool without the need for great expenditure of time and/or energy prior to use, such as the difficulties that might generally be associated with an inflatable pool. Moreover, the swimming pool of the present invention is robust, and is not easily broken, punctured, torn, or otherwise damaged, as is the case with known pools, especially known pools with portholes.

The pool will be described as incorporating a side wall, as a preferred embodiment comprises a circular-shaped pool having but a single side, but it will be understood by those skilled in the art that the pool can include more than one side.

In some embodiments, the pool comprises one or more improved potholes. The portholes can enable people outside the pool to see inside the pool, and people inside the pool to see outside the pool.

In some embodiments, the pool comprises a base, a side wall joined to the base, and a porthole. The sidewall can comprise a plastic. The porthole can comprise an aperture in the side wall and a window sheet. The window sheet can comprise two layers, and be attached to the side wall by at least two welds that are each continuous around the perimeter of the aperture. In some embodiments, the window sheet is attached to the sidewall by three welds that are continuous around the perimeter of the aperture.

In some embodiments, the two layers can comprise plastic and have a reinforcing mesh between them. In some embodiments, the window sheet can be transparent and the sidewall is not transparent. The plastic that forms the sidewall and the window sheet can be polyvinyl chloride (PVC).

In some embodiments, the fluid container comprises a base, a side wall joined to the base, and at least one substantially transparent porthole. The porthole can comprise an aperture in the side wall, and a generally transparent window sheet attached to the side wall and completely covering the aperture in the sidewall. The window sheet can be attached by one or more welds. The window sheet can further comprise a reinforcing mesh, which can be between two layers of clear plastic.

In some embodiments, the fluid container can further comprise a pocket sheet attached to the side wall, and a bracing sheet located between the pocket sheet and the side wall. The pocket sheet can be substantially rectangular, and can be attached to the side wall on three sides, but not on a top side, to create a pocket. The pocket can also include a sealing system. The bracing sheet can be more rigid than the pocket sheet.

In some embodiments, a method for assembling a fluid container can comprise the steps of providing a base, joining a side wall to the base, forming an aperture in the sidewall, and welding a generally transparent window sheet to the side wall such that the window sheet covers the aperture. The step of welding the window sheet to the sidewall can include forming at least two welds that are each continuous around the perimeter of the aperture. The window sheet can be embedded with mesh. In some embodiments, the window sheet can be reinforced with a polyester mesh.

Some embodiments of the method can include attaching a pocket sheet to the side wall to create a pocket, and providing a bracing sheet configured to be inserted between the pocket sheet and the side wall inside the pocket. The side wall and the window sheet can comprise polyvinyl chloride (PVC). The window sheet and the sidewall can be RF welded together.

In accordance with some embodiments, the pool can be supported by a frame. For example, supports, such as vertical rib supports, can be coupled proximate the side wall of the pool. The supports can be attached to some of the material making up the side wall, and can also be attached to a support ring proximate the top of the pool.

In accordance with some embodiments of the invention, a floatation device (which can be inflatable) can be positioned at the top rim of the collapsible pool. The floatation device can provide padding for those entering and exiting the pool, and can also provide a manner by which the pool changes from a collapsed to an expanded configuration with the addition of water within the pool. For instance, the flotation device can rise as the water level rises due to its buoyant properties, extending the material connecting the top of the pool, thereby erecting the side walls of the pool.

Further features of the invention, and the advantages offered thereby, are explained in greater detail hereinafter with reference to specific embodiments illustrated in the accompanying drawings, wherein like elements are indicated by like reference designators.

DETAILED DESCRIPTION

Figure 1:
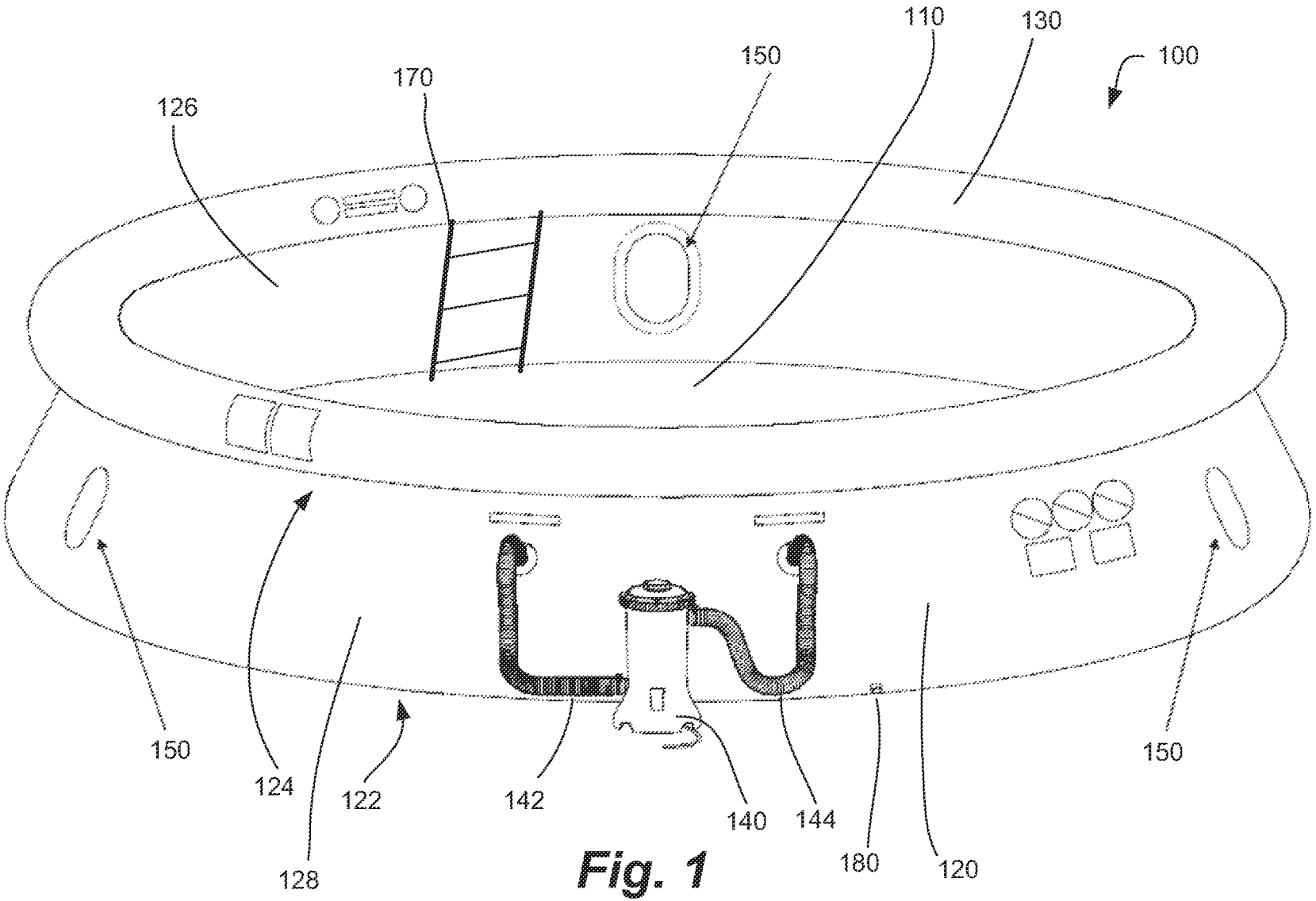
FIG. 1 is a perspective view of a container having portholes, in accordance with some embodiments of the present invention.

To facilitate an understanding of the principles and features of the various embodiments of the invention, various illustrative embodiments are explained below. Although embodiments of the invention are explained in detail as being systems and methods for a container with improved portholes, it is to be understood that other embodiments are contemplated, such as embodiments employing other types of containers, portholes, windows, materials, pools, and the like. Accordingly, it is not intended that the invention is limited in its scope to the details of construction and arrangement of components set forth in the following description or examples. The invention is capable of other embodiments and of being practiced or carried out in various ways. Also, in describing the embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of this disclosure, various illustrative embodiments are explained below. In particular, various embodiments of this disclosure are described as a pool with improved portholes. Some embodiments of the invention, however, may be applicable to other contexts, and embodiments employing these applications are contemplated. For example and not limitation, some embodiments of the invention may be applicable to various types of containers wherein the ability to see inside or outside of the container is desired, or wherein improved portability is desired. Accordingly, where terms such as "pool" or "porthole" or related terms are used throughout this disclosure, it will be understood that other devices, entities, objects, or activities can take the place of these in various embodiments of the invention.

As described above, a problem with existing above-ground pools is that they typically do not have portholes. Even when conventional pools do have portholes, however, the portholes cause leaks and compromise the structural integrity of the pool. More specifically, in conventional designs, water pressure can cause the welds between the portholes and side wall of the pool to weaken and eventually leak or rupture. Moreover, conventional designs are limited in size to smaller windows because larger windows leak and/or rupture more quickly. As also described above, conventional pools are not sufficiently portable and are difficult to store.

Embodiments of the present invention, however, can comprise improved potholes with improved durability. The improved portholes do not leak and do not compromise the integrity of the pool. Moreover, pools in accordance with this disclosure can be easily stored and are readily portable.

In some embodiments, pools are generally formed by joining a base, along its perimeter, to an erected side wall at or near one edge of the side wall. Along the edge of the side wall not joined to the base, either an upward force providing member or a shape retaining member, or a combination of the two, can be positioned. The upward force providing member or shape retaining member generally has at least a portion coupled proximate the end of the side wall not joined to the base (i.e., the top of the side wall). The upward force providing member can comprise a variety of different elements capable of aiding the transformation of the collapsible container from a collapsed configuration to an expanded configuration by erecting the side wall. For example, the upward force providing member might be a floating device that floats on liquid deposited in the container, causing the side wall to rise as more liquid is deposited in the container. The upward force providing member can also be a ring attached to the side wall and supported by support members.

A support member and/or shape retaining member can be formed from one or more support members having at least a portion coupled proximate to the side wall of the pool. For example, vertical rib supports can be used as an upward force providing member, a shape-retaining member, or both. Such vertical ribs can be formed from individual inflatable portions, or can be a foam insert, metal or polymer rod, or the like. According to some embodiments, such vertical ribs can be collapsible, being formed from collapsible inflatable portions, collapsible foam portions, or other suitable compositions.

In some embodiments, the pool includes at least one porthole in the side wall. In some embodiments, multiple portholes, such as one to twenty portholes, can be included. The portholes provide a window-like mechanism permitting one to see into the pool through the side wall. Similarly, the portholes enable one within the pool to see outside the pool. As discussed above, the integrity of the portholes can be of the utmost importance to prevent leaks and structural failure.

A container, or portable swimming pool, constructed in accordance with some embodiments of the invention, can be seen in the perspective view illustrated in FIG. 1. As shown in FIG. 1, a swimming pool 100 has a base 110 and a side wall 120, which is made from a physical material and is formed in a particular shape.

The pool 100 can be a frame pool or a pop-up type of pool, both of which being collapsible in nature. The frame pool is typically pre-fabricated and includes a plurality of external vertical braces or frames for supporting the frame pool above the ground. The pop-up pool is adapted to rise with the amount of water inserted into pool, and can also be outfitted with external braces or frames for additional support. As one skilled in the art would appreciate, other types of pools can be used with the present invention.

The shape of the pool 100 can be circular, elliptical, rectangular, or the like. Indeed, the pool 100 can be made in a variety of shapes, including, but not limited to, rectangular, square, oblong, oval-shaped, elliptical, rectangular with rounded corners, and the like. Thus, it will be apparent to one skilled in the art that the configuration of the pool 100 can be many shapes. Different shapes can result in the pool 100 having more than one side wall 120 forming the perimeter of the pool 100. Additionally, the pool 100 can be made in a variety of sizes, depending upon the desired use.

The pool 100 is formed with the base 110 and side wall 120. The base 110 and side wall 120 can be manufactured out of many different materials and can be formed of the same materials or each a different material. For example, the base 110 and side wall 120 of the swimming pool 100 can be formed from a textile (e.g., burlap, etc.) or synthetic material (e.g., plastics, polyurethane, PVC, nylon, etc). Many materials (especially water-permeable textiles, etc.) can be used to construct a pool; the materials, however, should be treated to retain water. For example, such materials could be adhered to, laminated with, coated with, or bonded to a material impermeable to water. In accordance with the embodiment shown in FIG. 1, the base 110 can be formed from a nylon shell, which can be laminated or otherwise treated to hold water. For example, the nylon shell might be bonded to another material, such as a polyurethane, PVC, vinyl, or other suitable impermeable lining to provide the desirable waterproof qualities, and to provide a more pleasing tactile quality to the interior of the pool 100. Similarly, the wall 120 of the pool 100 can be constructed from these materials, or other materials having similar suitable qualities. Many of the materials that are used can be selected for their durability.

For example, the base 110 can be formed from materials that are more durable than the side wall 120, as this section of the pool 100 would likely be subjected to more wear than that experienced by the side wall 120. Also, as described, the base 110 and side wall 120 can be formed from a combination of materials, which can be adhered or bonded together. The materials used for the various portions of the pool 100, including, for example, the base 110 and the side wall 120, can be joined by way of a number of commonly known suitable techniques, such as sewing, adhesives, bonding, lamination, RF welding, other suitable joining techniques, and the like. The connection of the base 110 to the side wall 120 can be along the bottom 122 of the side wall 120. The base 110 includes a perimeter, wherein the side wall 120 can be connected about the perimeter of the base 110.

In some embodiments, the side wall 120 can include an inner wall 126 and an outer wall 128. The inner wall 126 can be sealable to the outer wall 128 by welding, adhesives, or the like. The side wall 120 can be inflatable or non-inflatable. Further, the side wall 120 can be non-spring activated.

In some embodiments, the inner wall 126 can be made of pliable plastic, while the outer wall 128 is made of hard plastic. The inner wall 126 can thus limit leakage of liquid should the outer wall 128 crack. Likewise, the material of the inner wall 126 can be made of hard plastic, and the material of the outer wall 128 can be made of pliable material to protect from potential leakage should the hard plastic crack.

In another embodiment, the inner wall 126 can be made of hard plastic, while the outer wall 128 can also be made of hard plastic. In yet another embodiment, the inner wall 126 and the outer wall 128 can both be made of pliable material, such as pliable plastic.

As shown in FIGS. 1-4, the pool 100 can comprise a porthole 150, or a plurality thereof. The portholes 150 can be similar to a window permitting one to see into the pool 100 or out of the pool 100. The portholes 150 can further enable one to determine the level of liquid within the pool 100.

Figure 2:
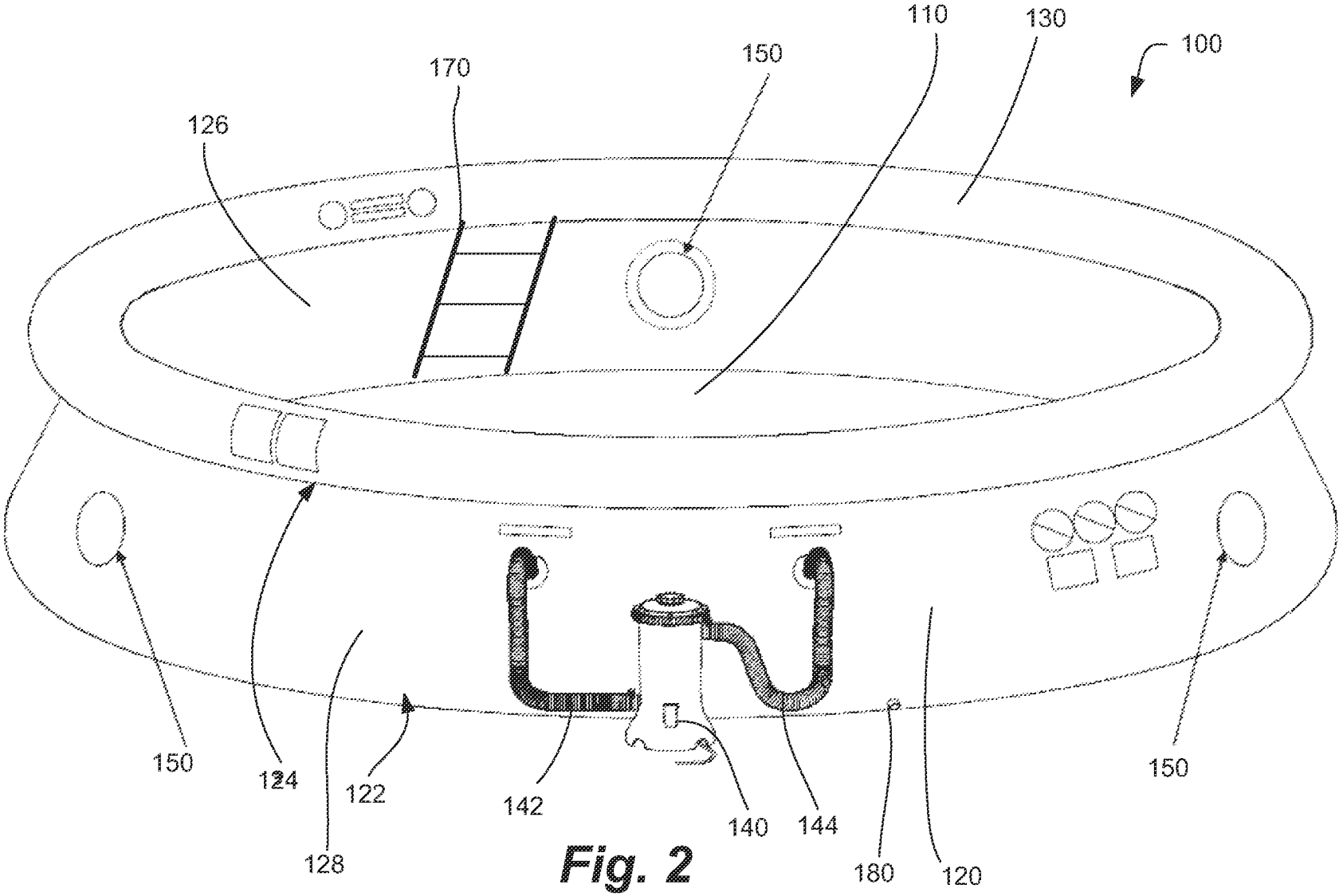
FIG. 2 is a perspective view of another container having portholes, in accordance with some embodiments of the present invention.
Figures 5A, 5B:
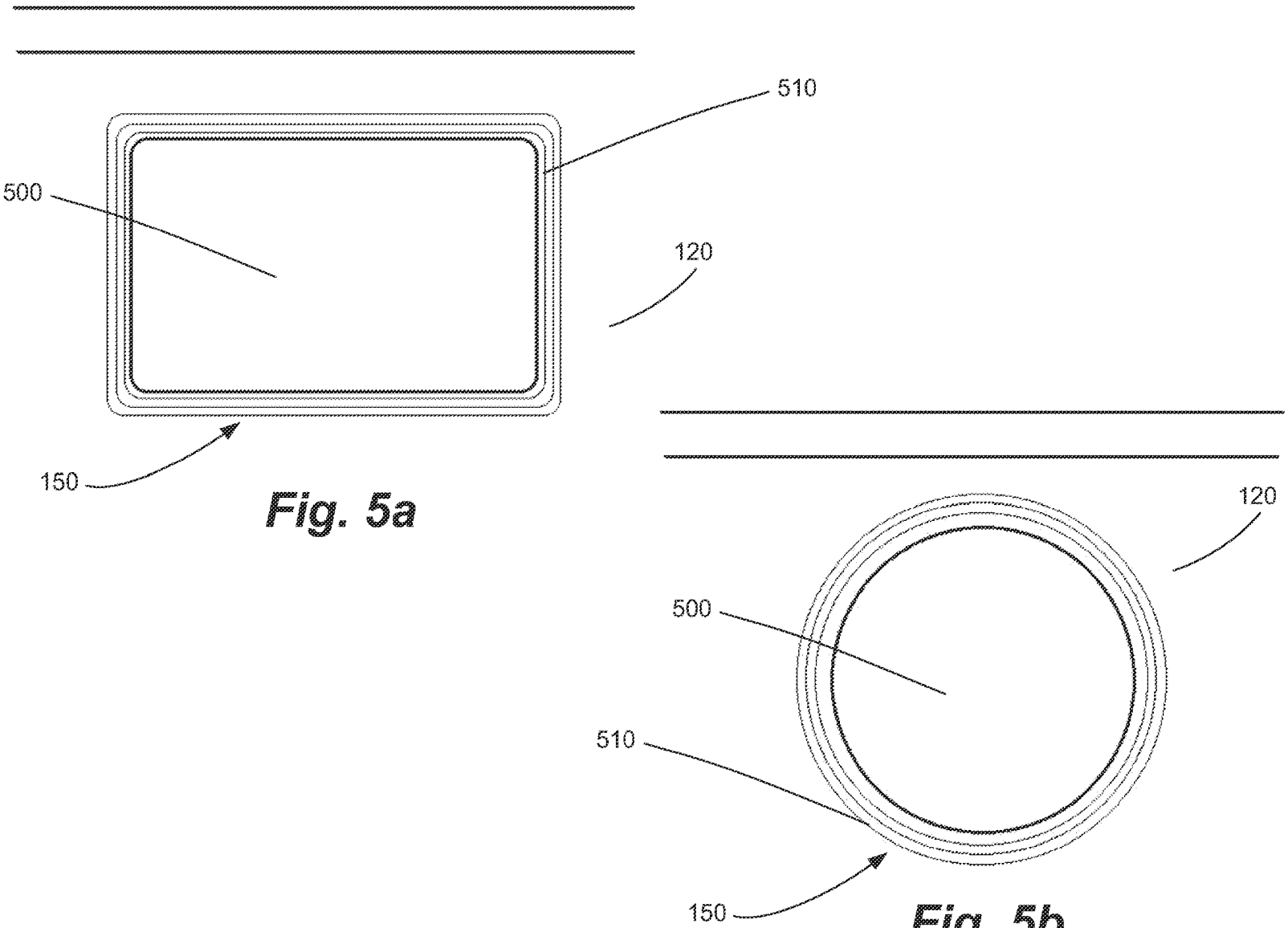
FIG. 5*a* is an interior view of a container having rectangular portholes, in accordance with some embodiments of the present invention.
FIG. 5*b* is an interior view of a container having circular portholes, in accordance with some embodiments of the present invention.

As also shown, for example, in FIGS. 1 and 2, the portholes 150 can be of a particular shape. In some embodiments, the shape of the portholes 150 can be determined by the shape of apertures cut into the walls 126, 128 of the pool 100. As shown in FIG. 1, the shape of the portholes 150 can be elliptical or substantially elliptical. As shown in FIG. 2, in some embodiments, the shape of the portholes 150 can be circular or substantially circular. As shown in FIG. 5*a*, in some embodiments, the shape of the portholes can be substantially rectangular with rounded corners. As will be apparent to one skilled in the art, however, the porthole 150 can be many shapes, such as square, rectangular, oblong, and the like. In some embodiments, as shown in FIGS. 1 and 2, the portholes 150 can be spaced evenly about the side wall 120.

FIGS. 5*a* and 5*b* illustrate two shapes for portholes 150 as viewed from the inside of the pool 100. Portholes 150 can comprise a generally transparent window sheet 500 that is attached to the side wall 120 (or inner wall 126). The window sheet 500 can be attached to the side wall 120 by welding the window sheet 500 to the side wall 120 with one or more welds 510. In some embodiments, the welds 510 can be made around the circumference of the aperture cut into the side wall 120, and can have substantially the same shape as the aperture. The welds 510 can be continuous welds, which can help prevent the fluid in the pool 100 from leaking. Successive welds 510 can be concentric and further from the center of the aperture in side wall 120, as illustrated in FIGS. 5*a* and 5*b*. Specifically, there can be two welds 510, three welds 510, four welds 510, five welds 510, or more, moving outward from the center of the aperture in the side wall 120. The successive welds 510 can aid in reinforcing the pothole 150 to make it more durable than known portholes. That is, since there can be a plurality of welds 510, if one weld 510 fails, the other welds 510 can maintain the integrity of the porthole 150 and thus the pool 100.

Alternatively or additionally, the window sheet 500 can be attached to the side wall 120 by using an adhesive substance.

The window sheet 500 can be substantially similar in shape to the aperture in side wall 120, but it can also be of a different shape. If the window sheet 500 is a different shape than the aperture it covers, the window sheet 500 can still be attached by welding or adhesive, however the welds need not be concentric. For example, there can be a weld near the outer edge of the window sheet 500, and a second weld closer to and surrounding the aperture in the wall.

In some embodiments, the window sheet 500 is attached to the sidewall 120 by securing it between inner wall 126 and outer wall 128. In such an embodiment, welding or adhesives may be used in a manner similar to that discussed above with respect to FIGS. 5*a* and 5*b*.

In some embodiments, the window sheet 500 can comprise a clear flexible polymer, such as flexible PVC. In some embodiments, the side wall 120 (or inner wall 126) can also be a flexible polymer, such as flexible PVC. The use of two similar materials can make attaching the window sheet 500 and the side wall 120 easier and also increase the strength of the attachment. Specifically, in some embodiments, such as embodiments employing high frequency welding (or RF welding) to form welds 510, it is desirable to have materials with similar melting points and chemical compositions to form a stronger weld 510 and make the welding process less complex.

Figures 6A, 6B:
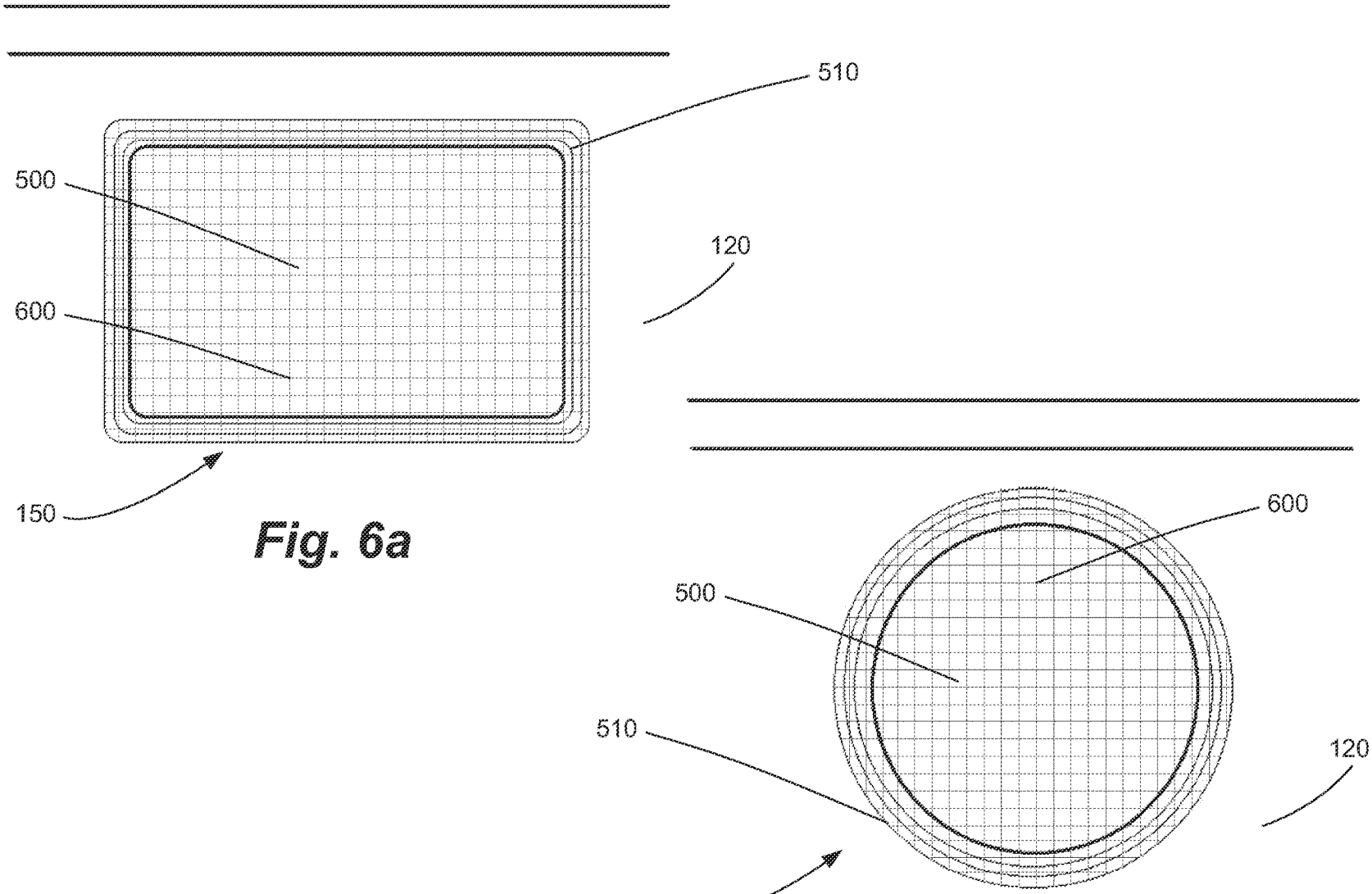
FIG. 6*a* is an interior view of a container having reinforced rectangular portholes, m accordance with some embodiments of the present invention.
FIG. 6*b* is an interior view of a container having reinforced circular portholes, in accordance with some embodiments of the present invention.

FIGS. 6*a* and 6*b* illustrate portholes 150 comprising a reinforced window sheet 500. The window sheet 500 material used in the embodiments shown in FIGS. 6*a* and 6*b* can be made by sandwiching two layers of clear material on either side of a mesh 600. In some embodiments, a woven polyester mesh 600 may be used between two sheets of clear plastic, such as flexible PVC. The use of mesh 600 provides the window sheet 500 with additional strength and allows window sheet 500 to better resist tearing or rupturing.

In some embodiments, a porthole 150 can further include two additional components. As shown in FIGS. 5*a* and 5*b*, the porthole 150 can comprise a clear window sheet 500 attached to the side wall 120 of the pool. In some embodiments, the window sheet 500 can be attached to the inner wall 126 or the outer wall 128 of the side wall 120 of the pool 100. Moreover, the window sheet can be attached between the inner wall 126 and the outer wall 128. In other words, the window sheet 500 can be "sandwiched" to and between the inner wall 126 and the outer wall 128, and attached to both walls by conventional means, such as by weld 510, adhesive, or the like. In some embodiments, therefore, the shape of the porthole 150 can be determined by the shape of the apertures cut into the walls 126, 128.

Figure 7:
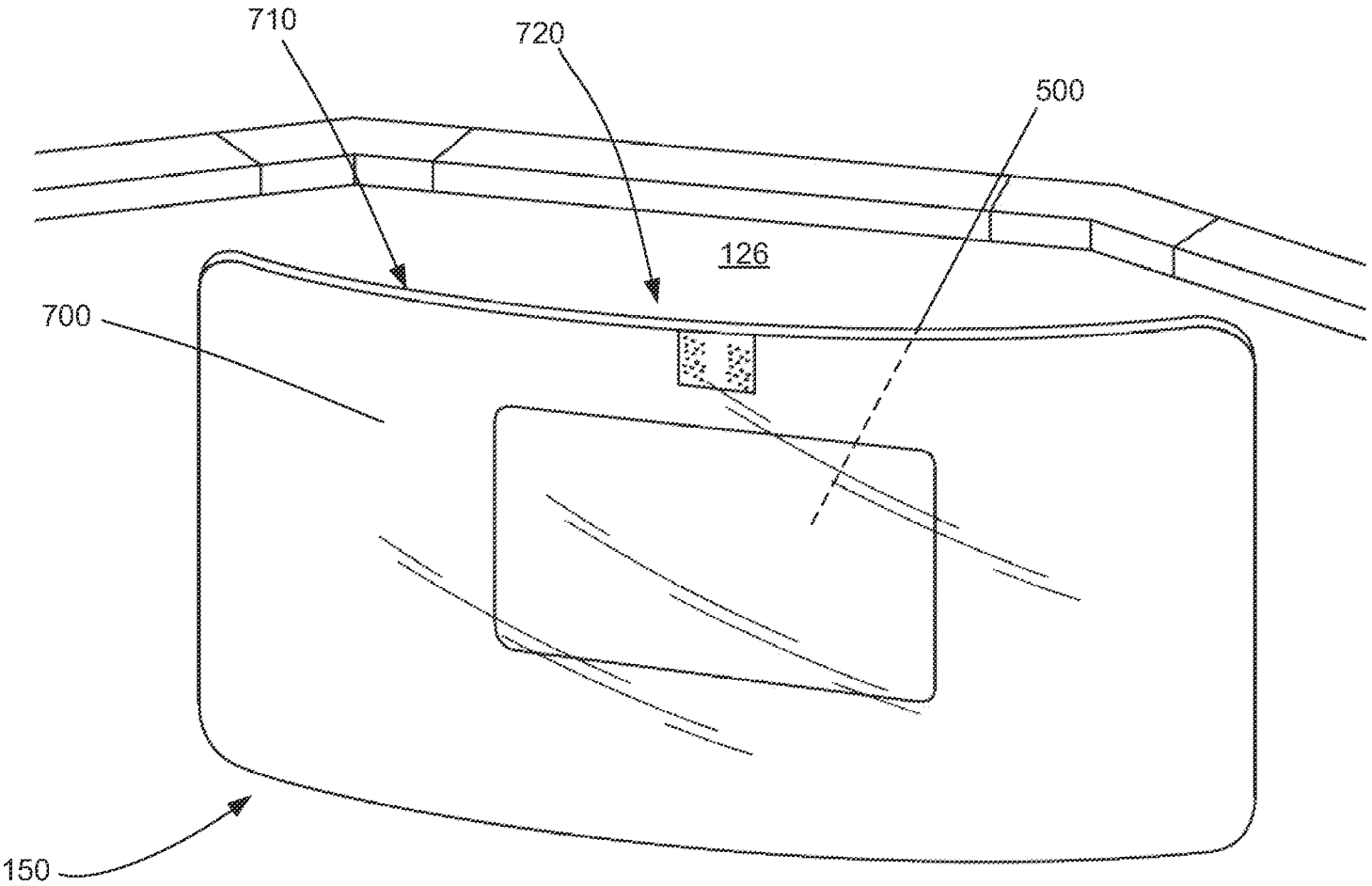
FIG. 7 is a perspective, interior view of the window and pocket sheets of a porthole, in accordance with some embodiments of the present invention.

As shown in FIG. 7, the porthole 150 can further comprise a pocket sheet 700. In some embodiments, the pocket sheet 700 can be attached to the inside of the inner wall 126. More specifically, in some embodiments, as shown in FIG. 7, multiple sides of the pocket sheet 700 can be attached to the inner wall 126 of the pool; however, as shown, not all sides of the pocket sheet 700 are necessarily attached to the inner wall 126. In some embodiments, for example, the pocket sheet 700 can be attached to the inside of the pool on all sides except for one side, or a portion of one side. As shown in FIG. 7, in some embodiments, the unattached side can be the top side 710. Thus, the pocket sheet 700 can create a sleeve or pocket 720 between the pocket sheet 700, an area of the inner wall 126, and the window sheet 500. Moreover, the opening of the pocket 720 can face upward, enabling access to the pocket 720 from the top.

In some embodiments, the window sheet 500 and pocket sheet 700 can be flexible. The sheets can comprise, for example and not limitation, a clear, flexible sheet of polyvinylchloride (PVC). However, other clear materials known in the art can be substituted. The flexibility of the window sheet 500 and the pocket sheet 700 enables easy opening and closing of the pocket 720.

Figure 8A:
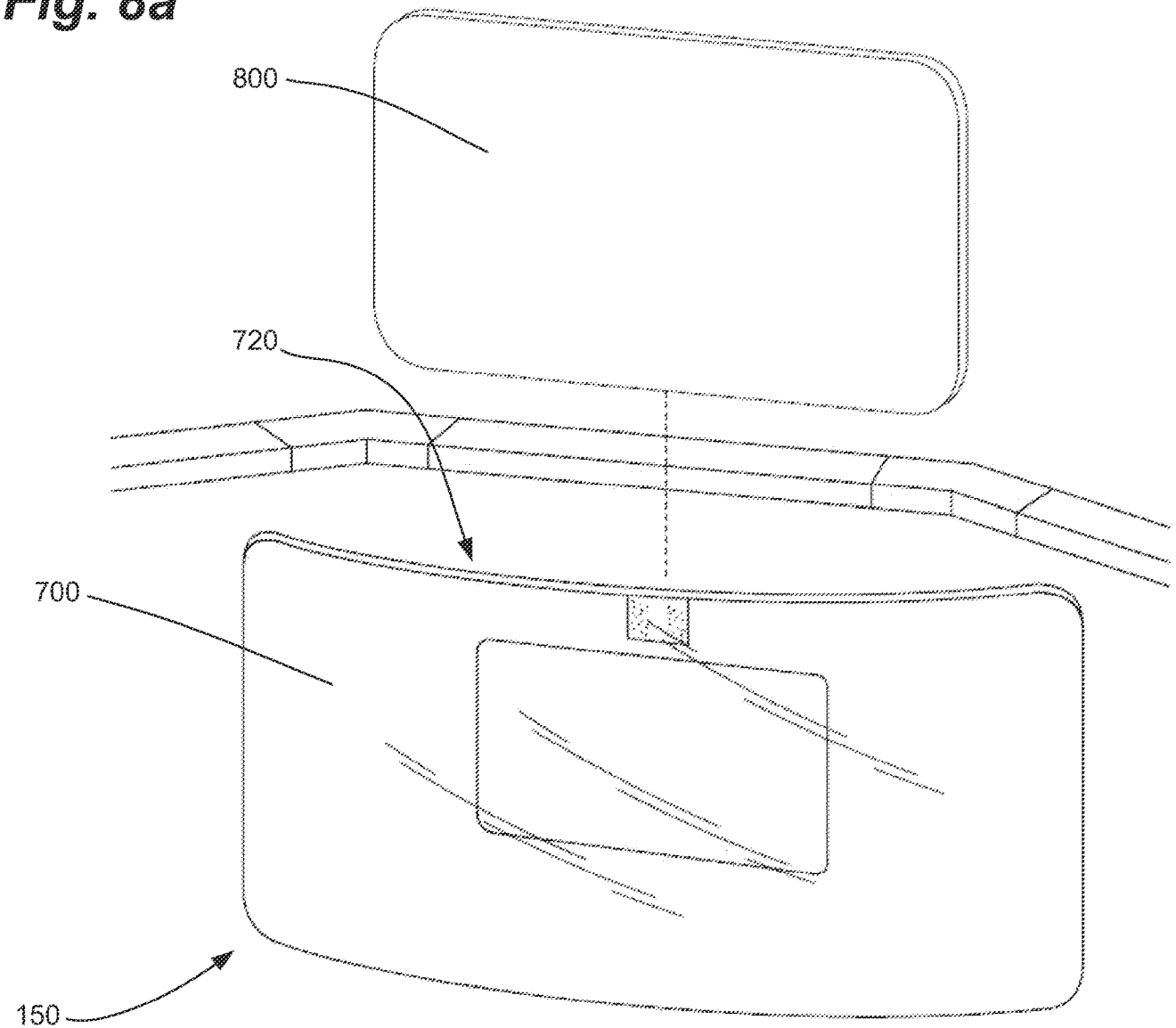
FIG. 8*a* is a perspective, interior view of a bracing sheet of a porthole being inserted into a pocket, in accordance with some embodiments of the present invention.

As shown in FIG. 8*a*, the porthole 150 can further comprise a bracing sheet 800 also comprising a clear material. In some embodiments the material of the bracing sheet 800 can be a clear, hard material, such as clear acrylic. In some embodiments, therefore, the bracing sheet 800 can be more rigid than the window sheet 500 and pocket sheet 700, but can still be somewhat flexible. In some embodiments, however, the bracing sheet 800 can be so rigid that it is not flexible.

Figure 8B:
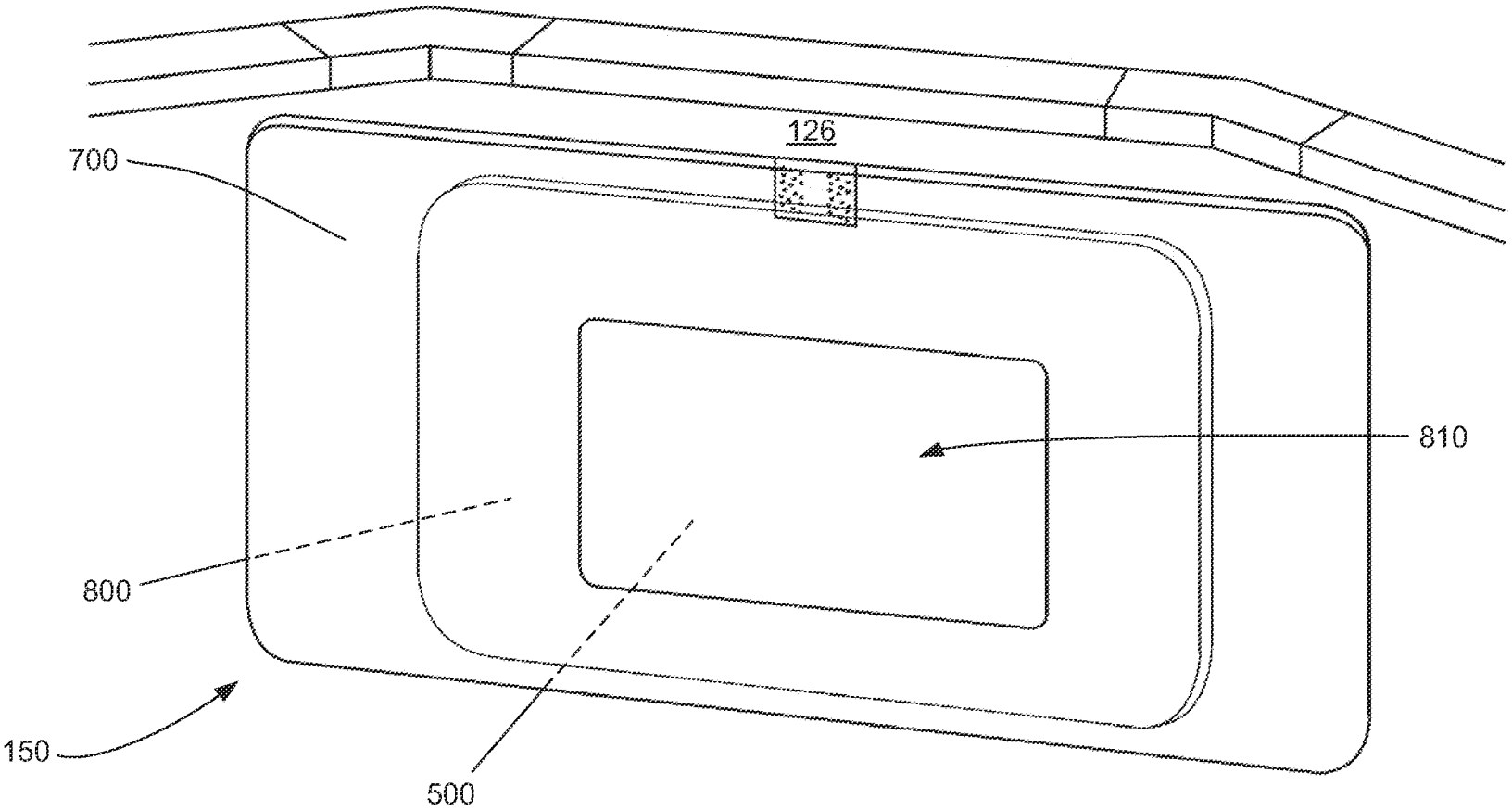
FIG. 8*b* is a perspective, interior view of an assembled porthole, in accordance with some embodiments of the present invention.

In some embodiments, as shown in FIGS. 8*a* and 8*b*, the bracing sheet 800 can slide into the pocket 720 created by the pocket sheet 700, an area of the inner wall 126, and the window sheet 500. As such, the bracing sheet 800 can provide strength and durability to the porthole 150 while maintaining the see-through nature of the porthole 150. As also shown in FIGS. 7*a* and 7*b*, in some embodiments, the bracing sheet 800 can be wider and taller than the see through portion 810 of the porthole 150, and the pocket sheet 700 can be wider and taller than the bracing sheet 800. This can enable the pocket sheet 700 to attach to the inner wall 126 while forming a pocket 720 that is large enough to receive the bracing sheet 800. In addition, since the bracing sheet 800 can extend outside the see-through portion 810 of the porthole 150, the third sheet can contact the window sheet 500 and the inner wall 126 when inside the pocket 720.

In some embodiments, the addition of the pocket sheet 700 and bracing sheet 800 can add significant strength and durability to the porthole 150, and can prevent the porthole 150 from leaking or compromising the structural integrity of the pool 100. More specifically, the addition of multiple sheets can add strength to the porthole. In addition, the extra strength provided by the pocket sheet 700 and rigidity provided by the bracing sheet 800 can prevent the pressure exerted by the water in the pool 100 from weakening the first sheet's 500 attachment to one or more of the walls 126, 128 of the pool 100.

Figure 9:
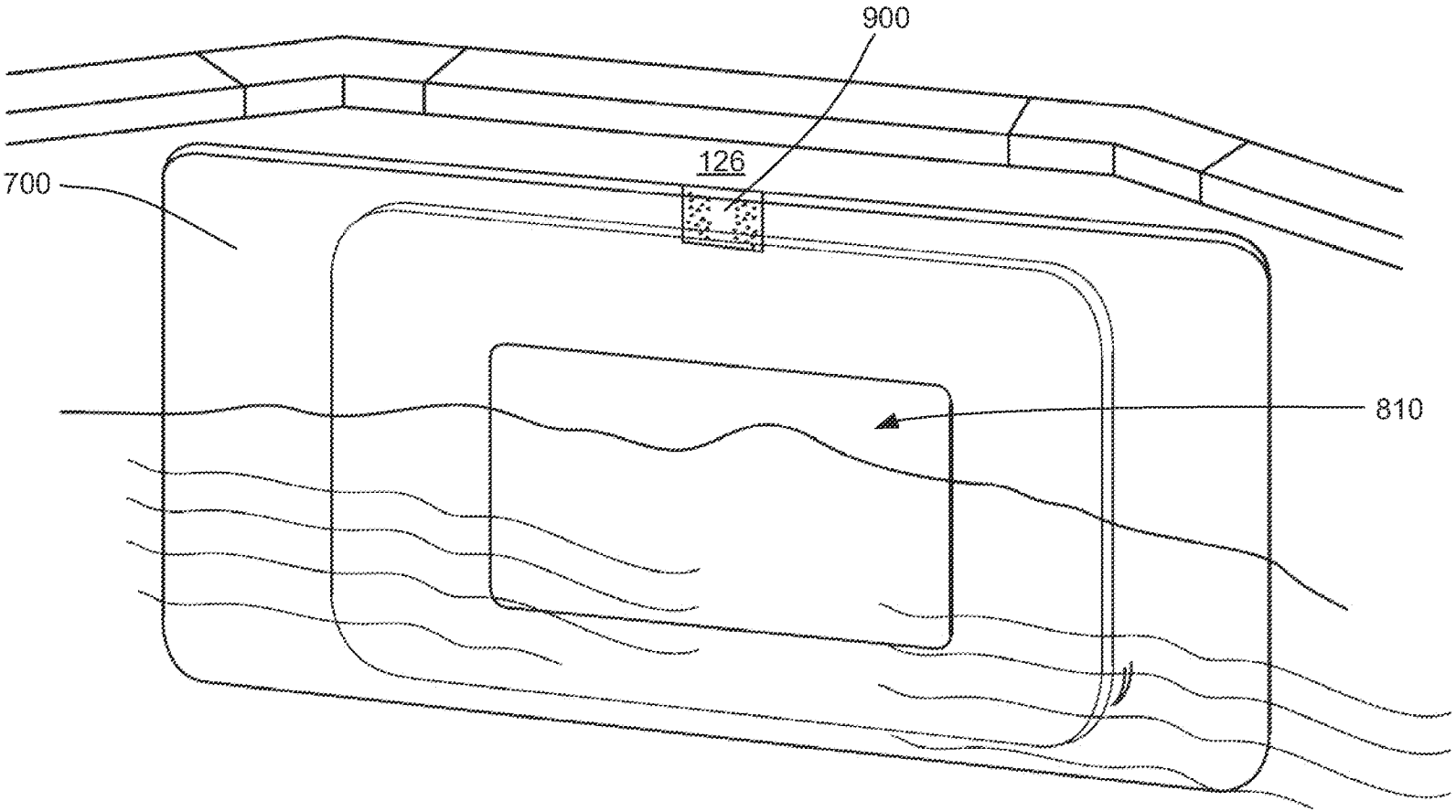
FIG. 9 is a perspective, interior view of a container having an assembled porthole and filled with water, in accordance with some embodiments of the present invention.

When the pool 100 is filled with water, as shown in FIG. 9, the pressure exerted by the water against the pocket sheet 700 pushes the pocket 720 closed. In some embodiments, the pocket sheet 700 can extend upward above the water line, enabling air to escape from the pocket 720 at the top as it is pushed closed, and ensuring that a significant amount of water does not enter the pocket 720 after it is closed. Thus, the pressure exerted by the water can press the pocket sheet 700 against the bracing sheet 800, and can press the bracing sheet 800 against the window sheet 500 and the inner wall 126. Accordingly, the pressure applied by the water can be distributed by the pocket sheet 700 and bracing sheet 800 over a large area, including a portion of the inner wall 126. This can take a significant amount of stress off of the window sheet 500, making the porthole 150 less likely to leak or fail. Furthermore, this pressure can secure the bracing sheet 800 within the pocket 720 such that it cannot be removed without significant effort.

As discussed above, the pocket sheet 700 extending upward above the water line can enable air to escape from the pocket 720 at the top as the pocket 720 is pushed closed. It can 720 is closed. These two advantages can additionally enable increased visibility through the porthole 150, as the amount additional air and water in the pocket 720 are minimized.

In some embodiments, once the bracing sheet 800 is inserted into the pocket 720, the pocket 720 can be sealed to retain the bracing sheet 800 in the pocket and to prevent water or air from entering the pocket. The pocket can be sealed, for example and not limitation, by a sealing system 800, as shown in FIG. 9. In some embodiments, the sealing system 800 can comprise a hook and loop system, such as Velcro®, or can be tongue and groove system, such as those traditionally used to seal plastic bags, such as sandwich bags. Accordingly, in some embodiments, the pocket 720 can be releasably sealed, such that it can be opened and closed repeatedly to enable repeated insertion and removal of the bracing sheet 800.

Allowing the bracing sheet 800 to be removed by the consumer offers several other advantages. In the case of pools that are designed to be folded and stored, a non-removable bracing sheet 800 would limit the flexibility of the pool storage as well as potentially cause wear on the pool material at the edges of the bracing sheet 800. Furthermore, a removable bracing sheet 800 can be replaced for maintenance or decorative purposes. Should one or more panels become clouded or cracked over time, a replacement panel could keep the pool usable for longer. Bracing sheets 800 can be produced having decorative patterns or color tints to suit a consumer's desires. For example, panels can be painted with bubbles, sea creatures, beach scenes, or other summer or pool themes.

The increased strength of the portholes 150 disclosed herein can enable the portholes 150 to be larger in size than conventional portholes. Traditionally, portholes were limited in side due to the stress exerted on the portholes by the water pressure. However, portholes 150 in accordance with the present invention can be larger than existing portholes due to their increased strength. These larger portholes 150 are more desirable to consumers as they enable a larger viewing area to see into or out of the pool.

Moreover, the portholes 150 can aid in safety, as the portholes 150 can enable improved viewing into the pool 100 through the side wall 120. If the portholes 150 are removably designed by suitable means, a porthole 150 can also be used as a drainage device, enabling quick emptying of the liquid of the pool 100. Thus, the portholes 150 can be integrally formed during manufacturing of the side wall 120, or can be removable, wherein the various sheets are removably attached via a waterproof and leak-proof method. The portholes 150, however, can also be attached via a non-removable method.

The pool 100 illustrated in FIG. 1 can further include a flotation device 130, which is formed in the shape of the pool 100, attached to the top 124 of the side wall 120. According to an embodiment shown in FIG. 1, the floatation device 130 can be an inflatable ring. This inflatable ring 130, when inflated, can provide some stiffness at the top 124 of the side wall 120, and can help maintain the overall shape of the pool 100. Moreover, the inflatable ring 130 can provide padding for those entering and exiting the pool 100, and can also provide a manner by which the pool 100 changes from a collapsed to an expanded configuration with the addition of water within the pool 100. Additionally, as the floatation device 130 can be buoyant, it can be made to rise with the level of water within the pool 100, such that as water is deposited in the pool 100 and the flotation device 130 rises with the level of that water, the side wall 120 is automatically erected as the pool 100 is filled.

The flotation device 130 can be made from a variety of materials. For example, the floatation device 130 can be a standard inflatable polyurethane casing, or similar casing that is suitable for retaining air or other gas in an inflated state. Additionally, the flotation device 130 can make use of a variety of chemical or other reactions that would automatically inflate it. The flotation device 130 can be inflated by conventional means, for example by a valve configured for oral inflation or for inflation by a device such as a pump, and the like.

The flotation device 130 can also be made from material that does not require inflation, but provides adequate buoyancy and floats on the water contained within the pool 100 (or other liquid when the pool is used as a general container). For example, special foams, polystyrene, or other materials can be used to create a flotation device 130, which would float with the water line contained in the pool 100, and cause the walls 120 to be erected as the pool 100 fills. In this manner, the pool 100 can automatically change from a collapsed to an expanded configuration. As the pool 100 is a collapsible pool, and adapted to be folded, the flotation device 130 can be made of a material that can be subjected to folding, without becoming damaged. Those skilled in the art will appreciate that, although some potential materials from which the flotation device 130 can be formed have been mentioned above, other materials including, but not limited to, newly developed materials can be incorporated within the design of the invention, and used to form the flotation device 130 without departing from the invention.

It will be appreciated by those skilled in the art that the flotation device 130 can be of a nature other than an inflatable ring. For example, this floatation device 130 can be made of a material that floats, and is bendable, such that it can be folded or bent.

The pool 100 can be conveniently collapsed for storage and/or transport by deflating the inflatable ring 130 and folding onto itself along with the base 110 and side wall 120 material in a manner that is well known.

The pool 100 can further include a pump device 140. The pump device 140 is adapted as a circulation system, and beneficially a cleaning system. The pump device 140 comprises a first tube 142 coupling a suction port of the pump 140 in fluid communication with a main drain or mobile cleaning device (neither shown) which draws water and settled debris from the bottom of the pool. The pool pump 140 can further comprise a second tube 144 to a coupling device which diverts a small portion of pool "return" water pumped from an outlet port of the pump 140. Further, pump 140 can be adapted to provide a jet of air bubbles in the water, for a Jacuzzi or spa effect.

Figure 3:
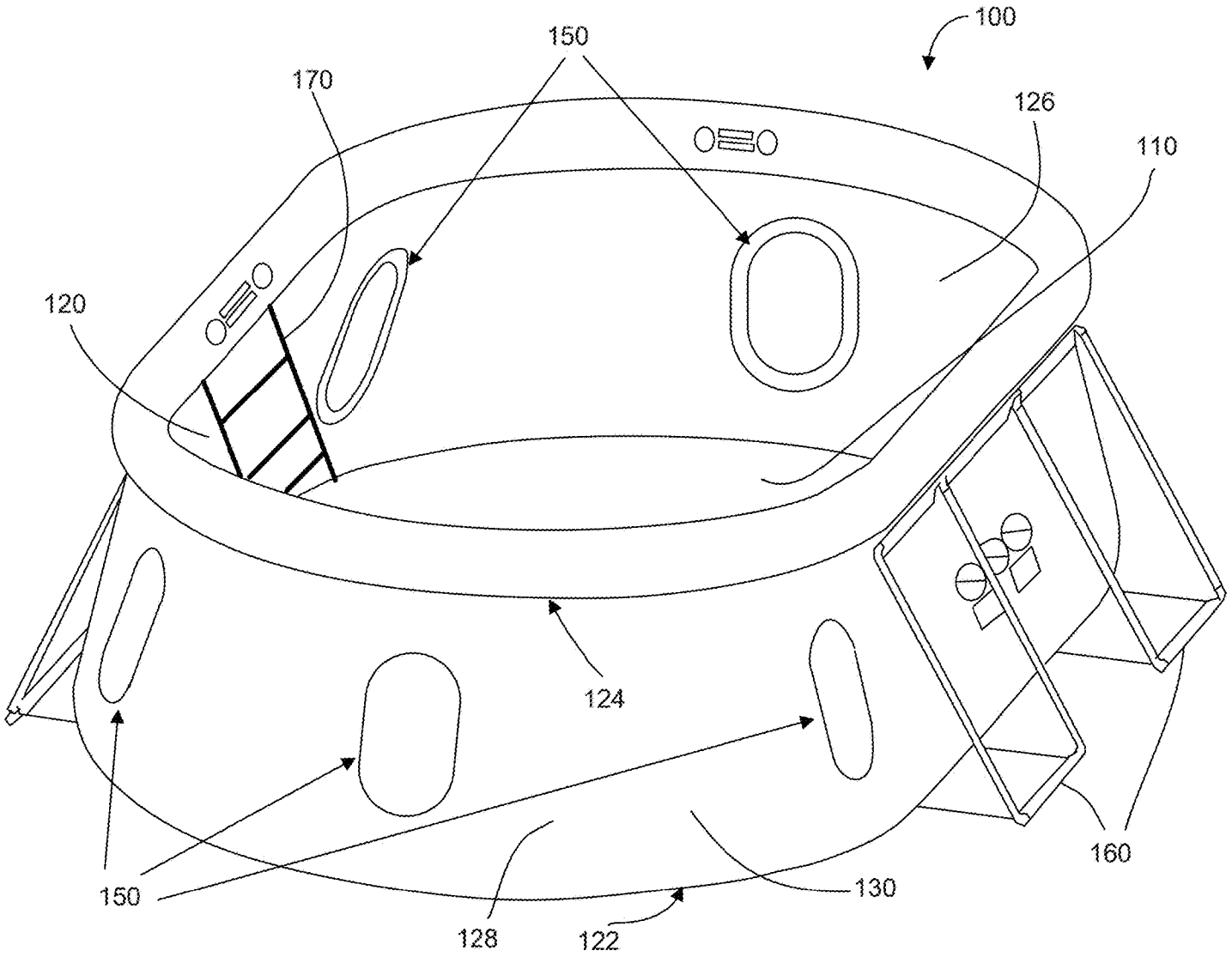
FIG. 3 is a perspective view of a container having portholes and braces, in accordance with some embodiments of the present invention.
Figure 4:
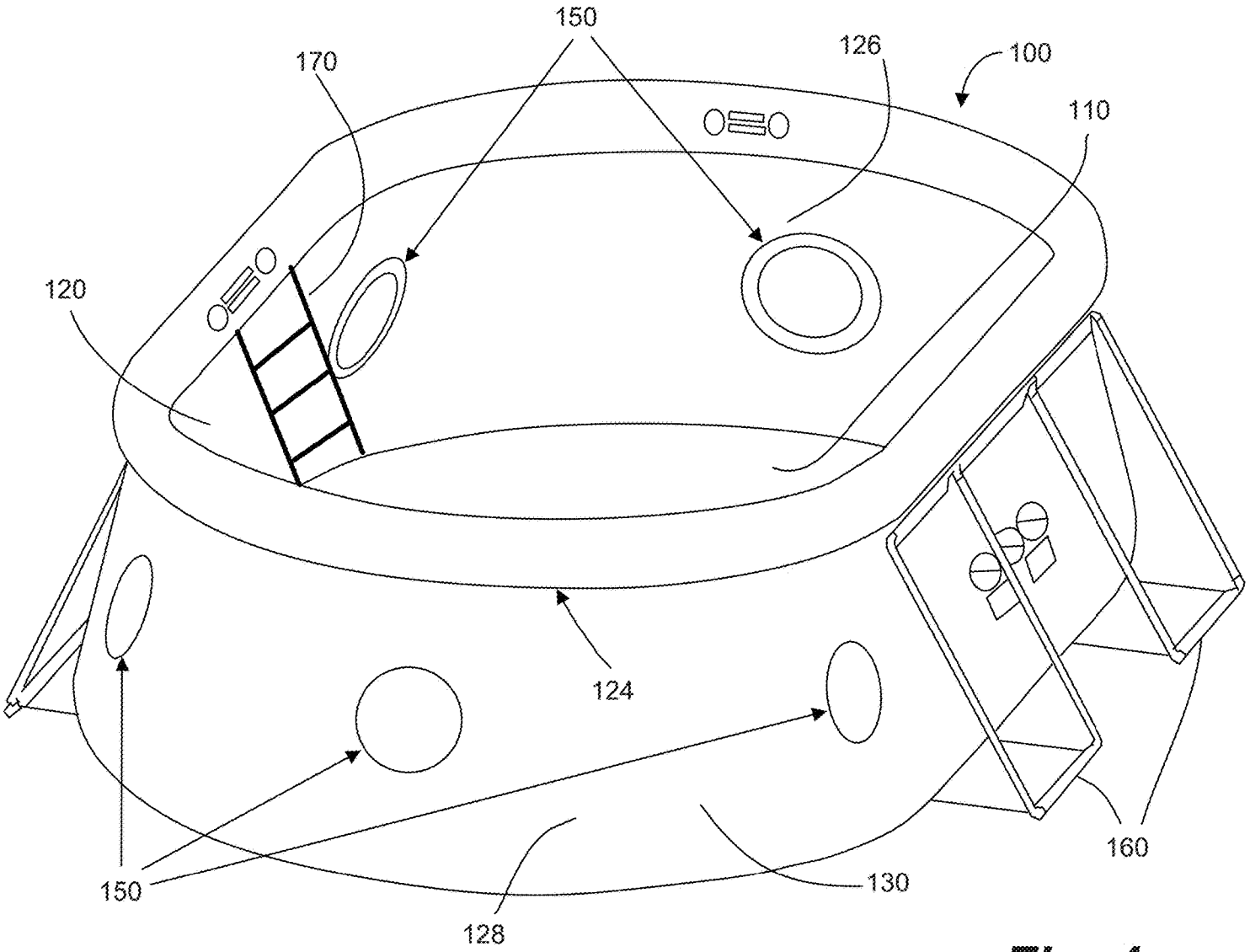
FIG. 4 is a perspective view of another container having portholes and braces, in accordance with some embodiments of the present invention.

FIG. 3 illustrates the pool 100 having a brace or structural support 160. The support 160 can include vertical rib supports, and can be coupled proximate to the side wall 120 of the pool 100. For example, the support 160 can be inserted within the material making up the side wall 120. The support members can comprise at least a portion of the flotation device 110 or a support member, and can have at least a portion coupled to the top of the side wall 120 and vertically along the side wall 120 to provide buoyancy and/or rigidity to the side wall 120. The support members 160 can comprise, for example, one or more inflatable bladders, collapsible foam, removable support members, or the like. FIG. 3, also, depicts oval shaped portholes 150. On the other hand, FIG. 4 depicts a similar embodiment as in FIG. 3, but with different shaped portholes 150.

One skilled in the art would appreciate that the support members 160 can be used on a frame pool, as well as a pop-up pool for supporting the pool above the ground. In some embodiments, the support members 160 are positioned outside the pool 100.

The pool 100 can include a ladder 170 to enable one to enter and/or exit the pool 100. The ladder 170 can be integral with the brace 160, or not. The ladder 170 can further be insertable into the pool 100, enabling one to exit the pool 100. Because a rim of the pool 100 is above the ground, the ladder 170 is preferably flush with the rim for easy entry/exit from the pool 100.

Because the pool 100 is collapsible, the liquid in the pool 100 should be drainable. Preferably, a drainage assembly 180 is integral with the pool 100. In some embodiments, the drainage assembly 180 is a cork or like device, that is removeable from the pool 100, such that, when removed the water from the pool 100 can be drained. The drainage assembly 180 can also be a valve enabling control of draining the pool 100. One skilled in the art would appreciate that the drainage assembly 180 can be many devices enabling easy draining of the pool 100, safely and environmentally.

Methods of manufacturing and assembling a pool 100 are also within the scope of this disclosure. In some embodiments, for example, a pool 100 can be manufactured as is known in the art, with additional method steps added to provide the portholes 150. For example, an aperture can be cut in the side wall 120. A window sheet 500 can be attached to sidewall 120 as described above by welding, adhesives, or other known methods. In some embodiments of pool 100 having an inner wall 126 and an outer wall 128, window sheet 500 can be attached to inner wall 126 only, between the inner wall 126 and the outer wall 128, or to outer wall 128 only.

In some embodiments, window sheet 500 with mesh 600 embedded therein can be manufactured and assembled. First, the mesh 600, which can be a polyester mesh 600, can be woven into a net. The mesh 600 can then be dipped into a bath of liquid glue, such as polyurethane based glue. The mesh 600 can then be run through a tunnel oven to heat up and semi-cure the glue. A layer of PVC (or other flexible plastic) can then be laid on top of the mesh and another layer on bottom, to create a "sandwich." The sandwich can then be heat rolled to cure the glue, and cooled. Once cooled, the sandwich can be cut into appropriate sizes and shapes for the window sheet 500.

In some embodiments, one or more welds 510 can be used to secure window sheet 500 to sidewall 120 or between inner wall 126 and outer wall 128. Welds 510 can be made around the perimeter of the aperture in side wall 120. In some embodiments, a plurality of welds 510 is employed. These welds 510 can be oriented in any way sufficient to provide a water tight seal. In some embodiments, the welds 510 can be arranged in a concentric manner around the aperture in the side wall 120 as illustrated in FIGS. 5*a* and 5*b*. This arrangement allows one or more of the welds 510 to fail, while still retaining a water tight seal around the porthole 150.

In other embodiments window sheet 500 can be attached to the inner wall 126, outer wall 128, or both, as described above. A pocket sheet 700 can then be attached to the inner wall 126, forming a pocket 720. A bracing sheet 800 can then be inserted into the pocket 720, forming the complete porthole 150. In this manner, one or a plurality of portholes 150 can be added to the pool 100.

From the foregoing, it can be seen that the invention provides a number of different collapsible containers with improved portholes, which can be used as swimming pool. The various embodiments of the invention described above provide collapsible swimming pools with improved portholes that are foldable, enable easy storage, and increase portability when compared with prior approaches. Additionally, according to various embodiments of the invention, the collapsible swimming pool of the invention can be provided with a pop-up mechanism that automatically erects the pool to its full-sized, expanded configuration. Thus, unlike prior approaches, the swimming pool of the invention can combine durable portholes with portability and storability with ready access for immediate use. Additionally, the swimming pool of the invention can be constructed from durable, lightweight, foldable materials which are not easily damaged, and therefore contribute to their long life.

It will be appreciated by those skilled in the art, however, that the invention can be embodied in other specific forms without departing from the spirit or essential characteristics thereof. For example, while the invention has been described in the context of swimming pool having portholes, generally used by children, the concepts described herein need not be limited to these illustrative embodiments. For example, swimming pools of larger sizes can be constructed using the same methods, and would enjoy the same benefits as the pools described above. Additionally, other types of containers having portholes, which can be used to contain liquids or other substances could be constructed using the principles of the invention and enjoy similar advantages as those described above.

Additionally, the specific configurations, choice of materials, and the size and shape of various elements, including portholes, could be varied according to particular design specifications or constraints requiring a container constructed according to the principles of the invention. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A pool comprising:
- a base;
- a side wall joined to the base, the sidewall constructed from a plastic, and the side wall having an aperture;
- a frame comprising vertical rib supports attached to the side wall; and
- a porthole comprising:
  - a window sheet with two layers attached to the side wall by at least one weld that is continuous around a perimeter of the aperture; and
- a pocket sheet welded to an interior of the side wall.

2. The pool of claim 1, wherein the vertical rib supports comprise at least one external vertical brace.

3. The pool of claim 1, wherein the vertical rib supports are inserted within the material of the side wall.

4. The pool of claim 3, wherein the vertical rib supports are configured to resist the water pressure on the porthole.

5. The pool of claim 1, wherein the vertical rib supports are collapsible.

6. The pool of claim 1, further comprising a flotation device to provide buoyancy to the side wall.

7. The pool of claim 1, further comprising support members comprising one of: inflatable bladders, collapsible foam, or removable support members.

8. The pool of claim 1, further comprising a drainage assembly.

9. The pool of claim 1, further comprising a ladder.

10. A fluid container comprising:
- a base;
- a side wall joined to the base;
- at least one substantially transparent porthole, the porthole comprising:
  - an aperture in the side wall;
  - a transparent window sheet attached to the side wall, attached by at least one weld;
- a pocket sheet welded to an interior of the side wall; and
- a bracing sheet more rigid than the pocket sheet.

11. The fluid container of claim 10, wherein the window sheet comprises:
- a first window sheet layer;
- a second window sheet layer; and
- a reinforcing mesh disposed between.

12. The fluid container of claim 10, wherein the pocket sheet is rectangular.

13. The fluid container of claim 12, wherein the pocket sheet is attached to the side wall on three sides, but not on a top side to create a pocket.

14. The fluid container of claim 13, wherein the pocket is sealable.

15. A method for assembling a pool, comprising:
- providing a base;
- joining a side wall constructed from a plastic to the base, the side wall having an aperture;
- welding a transparent window sheet to the side wall to cover the aperture;
- welding a pocket sheet to an interior of the side wall to create a pocket; and
- coupling vertical rib supports to proximate side wall of the pool by attaching the vertical rib supports to the material of the side wall and to a ring proximate to a top of the pool, wherein the ring is an upward force providing member attached to the side wall and supported by the vertical rib supports, wherein the vertical rib supports are a metal rod.

16. The method of claim 15, further comprising embedding the window sheet with polyester mesh.

17. The method of claim 15, further comprising placing a bracing sheet in the pocket.

18. The method of claim 15, wherein the window sheet and the side wall are welded together by a radio frequency welding process.

19. The method of claim 15, further comprising joining an inflatable flotation device to the top of the pool.

* * * * *